US009386391B2

(12) United States Patent
Madhu et al.

(10) Patent No.: US 9,386,391 B2
(45) Date of Patent: Jul. 5, 2016

(54) SWITCHING BETWEEN BINAURAL AND MONAURAL MODES

(71) Applicant: NXP B.V., Eindhoven (NL)

(72) Inventors: Nilesh Madhu, Leuven (BE); Sung Kyo Jung, Heverlee (BE); Ann Spriet, Bertem (BE); Wouter Tirry, Wijgmaal (BE); Vlatko Milosevski, Eindhoven (NL)

(73) Assignee: NXP B.V., Eindhoven (NL)

( * ) Notice: Subject to any disclaimer, the term of this patent is extended or adjusted under 35 U.S.C. 154(b) by 111 days.

(21) Appl. No.: 14/459,881

(22) Filed: Aug. 14, 2014

(65) Prior Publication Data

US 2016/0050509 A1 Feb. 18, 2016

(51) Int. Cl.

| | |
|---|---|
| ***H04S 7/00*** | (2006.01) |
| ***H04R 5/04*** | (2006.01) |
| ***H04R 5/033*** | (2006.01) |
| ***H04R 1/10*** | (2006.01) |

(52) U.S. Cl.

CPC ..... *H04S 7/304* (2013.01); *H04R 1/1041* (2013.01); *H04R 5/033* (2013.01); *H04R 5/04* (2013.01); *H04R 2201/109* (2013.01); *H04R 2460/01* (2013.01); *H04S 2400/15* (2013.01); *H04S 2420/01* (2013.01)

(58) Field of Classification Search

None

See application file for complete search history.

(56) References Cited

U.S. PATENT DOCUMENTS

| | | | | |
|---|---|---|---|---|
| 2007/0147630 | A1 | 6/2007 | Chiloyan | |
| 2008/0260180 | A1* | 10/2008 | Goldstein | H04R 25/50 381/110 |
| 2009/0281809 | A1* | 11/2009 | Reuss | G10L 17/24 704/273 |
| 2010/0189269 | A1 | 7/2010 | Haartsen et al. | |
| 2010/0324918 | A1* | 12/2010 | Almgren | H04W 28/24 704/502 |
| 2011/0144779 | A1* | 6/2011 | Janse | G11B 20/10009 700/94 |
| 2012/0148062 | A1 | 6/2012 | Scarlett et al. | |

FOREIGN PATENT DOCUMENTS

| | | | |
|---|---|---|---|
| WO | WO-2007/110807 | A2 | 1/2007 |
| WO | WO-2009/137147 | A1 | 11/2009 |

OTHER PUBLICATIONS

Extended European Search Report for Patent Appln. No. 15177797.6 (Jan. 15, 2016).

* cited by examiner

*Primary Examiner* — Wayne Young
*Assistant Examiner* — Mark Fischer
(74) *Attorney, Agent, or Firm* — Rajeev Madnawat

(57) ABSTRACT

A device including a processor and a memory is disclosed. The memory includes programming instructions which when executed by the processor perform an operation. The operation includes detecting relative position of two earphones when connected to the device, determining if a binaural signal processing mode is appropriate based on the detected relative position and switching to the binaural signal processing mode. If it is determined that the binaural signal processing mode is not appropriate, switching to monaural processing mode.

19 Claims, 4 Drawing Sheets

SWITCHING BETWEEN BINAURAL AND MONAURAL MODES

BACKGROUND

Binaural recording is a method of recording sound that uses two microphones, arranged with the intent to create a 3-D stereo sound sensation for the listener of actually being in the room with the performers or instruments. This effect is often created using a technique known as "Dummy head recording", wherein a mannequin head is outfitted with a microphone in each ear. Binaural recording is intended for replay using headphones and will not translate properly over stereo speakers.

Headphones (or earpieces) are commonly used with mobile devices. To improve the listening experience, active noise cancellation (ANC) methods are commonly used in these headphones. ANC methods typically require a microphone on each side of the stereo headset and a 5-pole connector to the device.

Given that these headphones have microphones built into the earphone casings, these headsets may be used for hands-free speech communication as well, removing the need for an extra microphone. However, since the microphones are on the earphones-casings, and on each side of the head (when in use), the speech signal these microphones pick up are attenuated (especially in the higher frequencies) due to the shadowing of the head. Thus some signal processing is usually required to compensate for this attenuation.

Another aspect to consider when using these headphones for communication is the impact of environmental (background) noise. This noise is detrimental to the intelligibility and the comfort of the communication, requiring some means of noise-suppression to suppress the environmental noise.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, a device including a processor and a memory is disclosed. The memory includes programming instructions which when executed by the processor perform an operation. The operation includes detecting relative position of two earphones when connected to the device, determining if a binaural signal processing mode is appropriate based on the detected relative position and switching to the binaural signal processing mode. If it is determined that the binaural signal processing mode is not appropriate, switching to monaural processing mode.

In another embodiment, a device connected to a network is disclosed. The device includes a processor and a memory. The memory includes programming instructions to configure a mobile phone when the programming instructions are transferred, via the network, to the mobile phone and executed by a processor of the mobile phone. After being configured through the transferred programming instructions, the mobile phone performs an operation. The operation includes detecting relative position of two earphones when connected to the device and determining if a binaural signal processing mode is appropriate based on the detected relative position and switching to the binaural signal processing mode. It is determined that the binaural signal processing mode is not appropriate, switching to monaural processing mode.

In yet another embodiment, a method performed in a device having two earphones for processing incoming speech signals is disclosed. The method includes detecting relative position of the two earphones when connected to the device and determining if a binaural signal processing mode is appropriate based on the detected relative position and switching to the binaural signal processing mode. If it is determined that the binaural signal processing mode is not appropriate, switching to monaural processing mode.

The programming instructions further include one or more of a module for detecting speech activity in a signal frame, a module for detecting if a signal frame is localized around a user's mouth, a module for detecting if a source of a signal frame is located about a user's head, a module for detecting if a signal frame contains speech from a target speaker, wherein the device includes vocal statistics of the target speaker and a module for switching between a binaural processing mode and a monaural processing mode.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. Advantages of the subject matter claimed will become apparent to those skilled in the art upon reading this description in conjunction with the accompanying drawings, in which like reference numerals have been used to designate like elements, and in which:

DETAILED DESCRIPTION

At least two microphones, separated in space and around a head, allow the use of more sophisticated methods to suppress the environmental noise than possible with single-microphone approaches. The usage of such noise reduction and binaural technologies is practical if the microphones in the array maintain a fixed spatial relation with respect to each other.

However, often the wearers of such headsets tend to remove one ear-piece from time-to-time. This might be for purposes of comfort or for paying more attention to the environment they are in. In such situations, the relative positions of microphones is unknown, could be time-varying and difficult to estimate. Also, it might be that the microphones in such a situation would be subject to different noise fields and different signal-to-noise ratios. Therefore, in such cases the binaural mode of signal processing would not optimal and it would be beneficial to switch to the monaural mode of signal processing to avoid speech degradation and noise pumping.

In some solutions, out-of-ear detection of an ear-piece is accomplished by measuring the coupling between the speaker and the microphone of an ear-piece using an injected signal. However, this solution is unreliable because it is difficult to detect the injected signal in noisy environments.

Prior to describing the subject matter in detail, an exemplary hardware device in which the subject matter may be implemented is described. Those of ordinary skill in the art will appreciate that the elements illustrated in FIG. 1 may vary depending on the system implementation.

Figure 1:
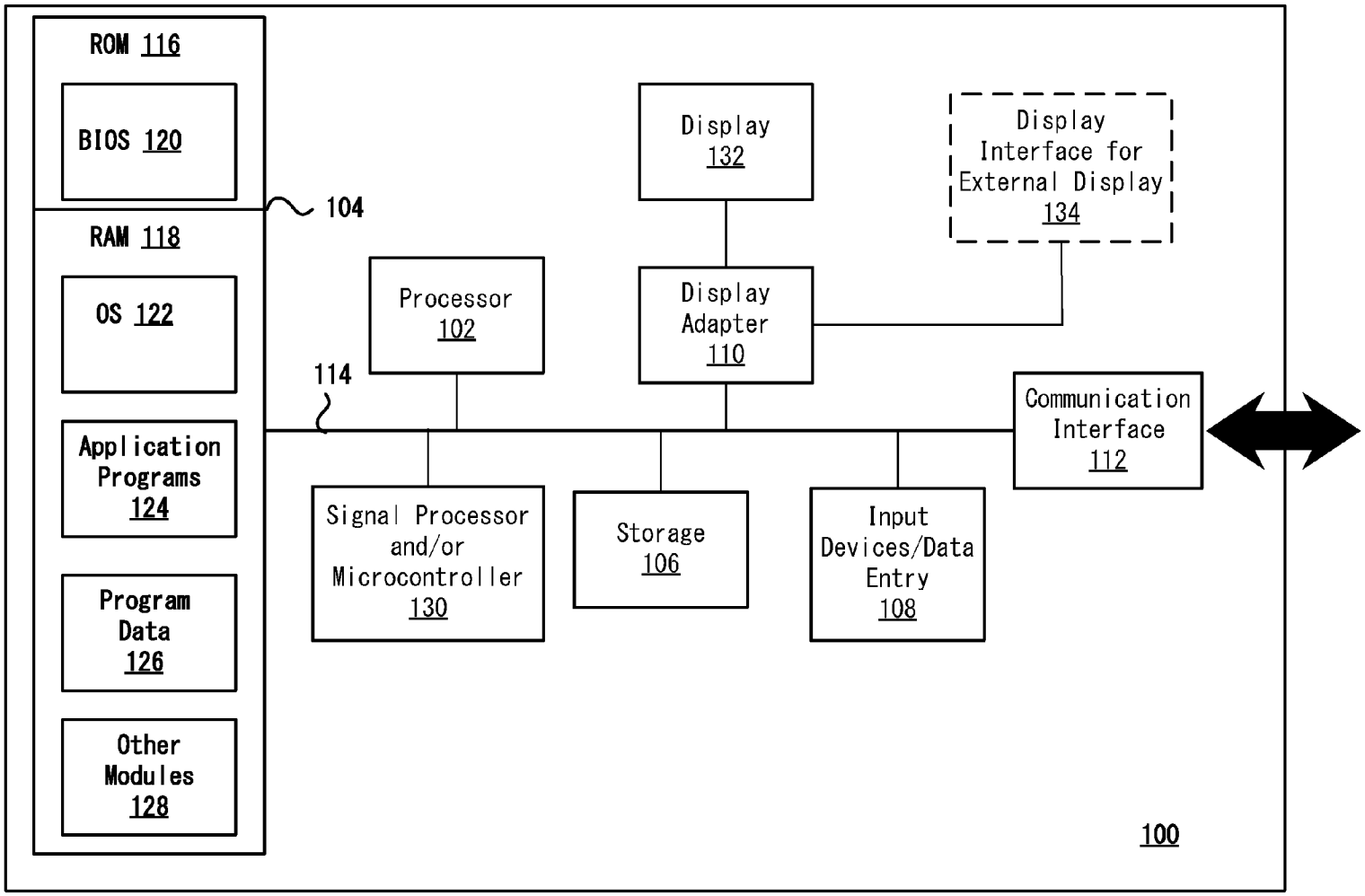
FIG. 1 is a block diagram illustrating an example hardware device in which the subject matter may be implemented.

FIG. 1 illustrates a hardware device in which the subject matter may be implemented. Those of ordinary skill in the art will appreciate that the elements illustrated in FIG. 1 may vary depending on the system implementation (e.g., a mobile device, a tablet computer, laptop computer, etc.). With reference to FIG. 1, an exemplary system for implementing the subject matter disclosed herein includes a hardware device 100, including a processing unit 102, memory 104, storage 106, data entry module 108, display adapter 110, communication interface 112, and a bus 114 that couples elements 104-112 to the processing unit 102.

The bus 114 may comprise any type of bus architecture. Examples include a memory bus, a peripheral bus, a local bus, etc. The processing unit 102 is an instruction execution machine, apparatus, or device and may comprise a microprocessor, a digital signal processor, a graphics processing unit, an application specific integrated circuit (ASIC), a field programmable gate array (FPGA), etc. The processing unit 102 may be configured to execute program instructions stored in memory 104 and/or storage 106 and/or received via data entry module 108.

The memory 104 may include read only memory (ROM) 116 and random access memory (RAM) 118. Memory 104 may be configured to store program instructions and data during operation of device 100. In various embodiments, memory 104 may include any of a variety of memory technologies such as static random access memory (SRAM) or dynamic RAM (DRAM), including variants such as dual data rate synchronous DRAM (DDR SDRAM), error correcting code synchronous DRAM (ECC SDRAM), or RAMBUS DRAM (RDRAM), for example. Memory 104 may also include nonvolatile memory technologies such as nonvolatile flash RAM (NVRAM) or ROM. In some embodiments, it is contemplated that memory 104 may include a combination of technologies such as the foregoing, as well as other technologies not specifically mentioned. When the subject matter is implemented in a computer system, a basic input/output system (BIOS) 120, containing the basic routines that help to transfer information between elements within the computer system, such as during start-up, is stored in ROM 116.

The storage 106 may include a flash memory data storage device for reading from and writing to flash memory, a hard disk drive for reading from and writing to a hard disk, a magnetic disk drive for reading from or writing to a removable magnetic disk, and/or an optical disk drive for reading from or writing to a removable optical disk such as a CD ROM, DVD or other optical media. The drives and their associated computer-readable media provide nonvolatile storage of computer readable instructions, data structures, program modules and other data for the hardware device 100.

It is noted that the methods described herein can be embodied in executable instructions stored in a computer readable medium for use by or in connection with an instruction execution machine, apparatus, or device, such as a computer-based or processor-containing machine, apparatus, or device. It will be appreciated by those skilled in the art that for some embodiments, other types of computer readable media may be used which can store data that is accessible by a computer, such as magnetic cassettes, flash memory cards, digital video disks, Bernoulli cartridges, RAM, ROM, and the like may also be used in the exemplary operating environment. As used here, a "computer-readable medium" can include one or more of any suitable media for storing the executable instructions of a computer program in one or more of an electronic, magnetic, optical, and electromagnetic format, such that the instruction execution machine, system, apparatus, or device can read (or fetch) the instructions from the computer readable medium and execute the instructions for carrying out the described methods. A non-exhaustive list of conventional exemplary computer readable medium includes: a portable computer diskette; a RAM; a ROM; an erasable programmable read only memory (EPROM or flash memory); optical storage devices, including a portable compact disc (CD), a portable digital video disc (DVD), a high definition DVD (HD-DVD™), a BLU-RAY disc; and the like.

A number of program modules may be stored on the storage 106, ROM 116 or RAM 118, including an operating system 122, one or more applications programs 124, program data 126, and other program modules 128. A user may enter commands and information into the hardware device 100 through data entry module 108. Data entry module 108 may include mechanisms such as a keyboard, a touch screen, a pointing device, etc. Device 100 may include a signal processor and/or a microcontroller to perform various signal processing and computing tasks such as executing programming instructions to detect ultrasound signals and perform angle/distance calculations, as described above. By way of example and not limitation, external input devices may include one or more microphones, joystick, game pad, scanner, or the like. In some embodiments, external input devices may include video or audio input devices such as a video camera, a still camera, etc. Input device port(s) 108 may be configured to receive input from one or more input devices of device 100 and to deliver such inputted data to processing unit 102 and/or signal processor 130 and/or memory 104 via bus 114.

Optionally, a display 132 is also connected to the bus 114 via display adapter 110. Display 132 may be configured to display output of device 100 to one or more users. In some embodiments, a given device such as a touch screen, for example, may function as both data entry module 108 and display 132. External display devices may also be connected to the bus 114 via optional external display interface 134. Other peripheral output devices, not shown, such as speakers and printers, may be connected to the hardware device 100.

The hardware device 100 may operate in a networked environment using logical connections to one or more remote nodes (not shown) via communication interface 112. The remote node may be another computer, a server, a router, a peer device or other common network node, and typically includes many or all of the elements described above relative to the hardware device 100. The communication interface 112 may interface with a wireless network and/or a wired network. Examples of wireless networks include, for example, a BLUETOOTH network, a wireless personal area network, a wireless 802.11 local area network (LAN), and/or wireless telephony network (e.g., a cellular, PCS, or GSM network). Examples of wired networks include, for example, a LAN, a fiber optic network, a wired personal area network, a telephony network, and/or a wide area network (WAN). Such networking environments are commonplace in intranets, the Internet, offices, enterprise-wide computer networks and the like. In some embodiments, communication interface 112 may include logic configured to support direct memory access (DMA) transfers between memory 104 and other devices.

In a networked environment, program modules depicted relative to the hardware device 100, or portions thereof, may be stored in a remote storage device, such as, for example, on a server. It will be appreciated that other hardware and/or software to establish a communications link between the hardware device 100 and other devices may be used.

It should be understood that the arrangement of hardware device 100 illustrated in FIG. 1 is just one possible implementation and that other arrangements are possible. It should also be understood that the various system components (and means) defined by the claims, described below, and illustrated in the various block diagrams represent logical components that are configured to perform the functionality described herein. For example, one or more of these system components (and means) can be realized, in whole or in part, by at least some of the components illustrated in the arrangement of hardware device 100. In addition, while at least one of these components are implemented at least partially as an electronic hardware component, and therefore constitutes a machine, the other components may be implemented in software, hardware, or a combination of software and hardware. More particularly, at least one component defined by the claims is implemented at least partially as an electronic hardware component, such as an instruction execution machine (e.g., a processor-based or processor-containing machine) and/or as specialized circuits or circuitry (e.g., discrete logic gates interconnected to perform a specialized function), such as those illustrated in FIG. 1. Other components may be implemented in software, hardware, or a combination of software and hardware. Moreover, some or all of these other components may be combined, some may be omitted altogether, and additional components can be added while still achieving the functionality described herein. Thus, the subject matter described herein can be embodied in many different variations, and all such variations are contemplated to be within the scope of what is claimed.

Figure 2A:
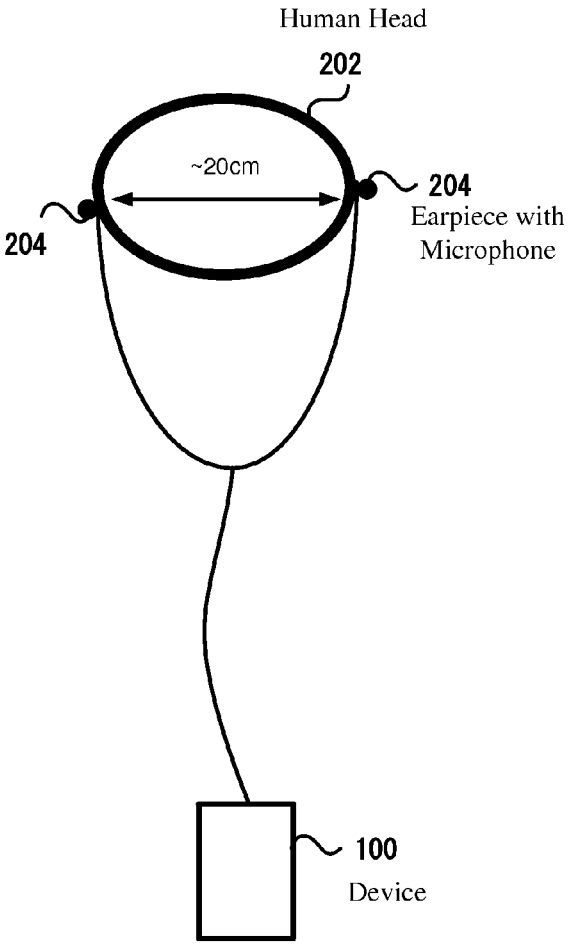
FIGS. 2A and 2B illustrate schematics depicting a practical use of earpieces.
Figure 2B:
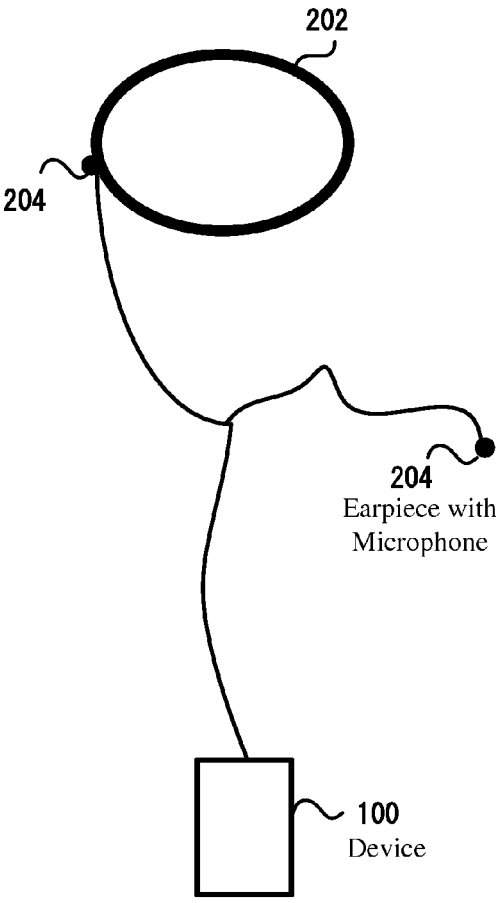

FIGS. 2A and 2B illustrate conditions under which binaural and monaural processing modes are appropriate. FIG. 2A shows the device 100 connected to headphone cable that includes two earpieces 204. Each earpiece 204 includes speaker and a microphone. Typically, the microphone faces outward of human head 202 when the earpiece is adopted in the ear canal during its use.

During their use, the earpieces 204 are typically approximately 20 cm apart from each other. In this position, the signal processor 130 of the device 100 is switched to use binaural signal processing. FIG. 2B shows that one of the earpieces 204 not being adopted to the ear and its current position (and distance) from the other earpiece is unknown or variable. Since binaural signal processing is optimized keeping in mind specific characteristics of human head and ear locations, continuing to use binaural signal processing when the two earpieces 204 are not in the position that mimics human ear locations, will cause speech degradation and/or deformation. Therefore, embodiments described herein determine if the relative positions of the two earpieces are suitable for binaural signal processing. If it is determined that the earpieces are not positioned for binaural signal processing, the signal processing mode of the signal processor 130 is switched to monaural signal processing.

In one or more embodiments, the relative movement of the ear-pieces with respect to their usual positions in ears can be detected by exploiting spatial and spectral characteristics of a speech signal. Spatial characteristics can be, for example, the position of the peak of the cross-correlation function between the signals at the two microphones embodied in the earpieces 204. For the normal (binaural-compatible) position, the peak would be approximately time-lag 0. A significant shift in the position of the peak would indicate a binaural-incompatible configuration.

In another embodiment, when an earpiece is taken off an ear, the position of the peak shifts. This shift in the peak of the cross correlation function can be used for switching between the binaural and monaural signal processing modes. Similarly, in the spectral domain, the target speech spectrum (of the user's speech) would be similar on both microphones when they are in the normal position. In this position, the high-frequencies of the user speech signal are attenuated due to the head-shadow effect, thus changing the spectral balance. When one earpiece is off-ear, the speech received on this microphone is no-longer subject to the head-shadowing effect and the spectral balance changes. This change in spectrum may be used to detect when the microphones are moved relative to their normal position, as depicted in FIG. 2A.

Typically, the multi-microphone speech processing is only useful if the desired source and the noise sources are not co-located. In such cases, the spatial diversity can be utilized (e.g., using beamforming techniques) to selectively preserve signals in the direction of the speech source while attenuating noises from elsewhere. Beamforming or spatial filtering is a signal processing technique used in sensor arrays for directional signal transmission or reception. This is achieved by combining elements in a phased array in such a way that signals at particular angles experience constructive interference while others experience destructive interference. Beamforming can be used at both the transmitting and receiving ends in order to achieve spatial selectivity. The improvement compared with omnidirectional reception/transmission is known as the receive/transmit gain (or loss).

Beamforming implies that the target speech signal must be "seen" as coming from a fixed direction, which is not co-located with interfering sources. This can be determined again from spatial characteristics (e.g., peak of cross-correlation function, phase differences between the microphones at each frequency) measured during speech and noise-only time segments. If such spatial characteristics do not yield an unambiguous position estimate, it is assumed that the earpieces are not in a binaural-compatible position. The robustness of determining if the headphones are in position that is suitable for the binaural signal processing, the term "binaural compatibility" can be defined as 'both earpieces in or closely around ears', in which case the spectral features such as spectral-balance, spectral tilt, etc. may also be used to determine if the microphones are in the desired position to perform binaural processing.

Various steps to make a determination whether a binaural processing mode is appropriate may be performed through software modules stored in the storage 106. One or more of these software modules can be loaded in RAM 118 at runtime and executed by the processor 102 or by the signal processor 130 or both in a cooperating manner. In another embodiment, the software modules may also be embodied in ROM 116. A person skilled in the art would appreciate that the functionality provided by the software modules may also be implemented in hardware without undue experimentation. Further, the software modules in form as a mobile application setup may also be stored on a server that is connected to a network and a user of the device 100 may download the application to the device 100 via the network. Once the downloaded application is installed, some or all software modules will be available to perform operations according to the embodiments described herein.

A module for detecting speech activity in a signal frame is provided. In one example, the detection of speech-presence or speech-absence in a particular frame is done by computing the spectral and temporal statistics of an input signal. Example statistics could be the signal-to-noise ratio (SNR), assuming that segments with an SNR above a threshold contain speech. Other statistics such as power and higher order moments, as well as speech detection based on speech specific features (for example pitch detection) may also be used to facilitate this detection.

If the current input frame is detected as containing speech, the system further detects if the signal arriving at the microphones is localized in space, and around the user's mouth. Sound localization refers to a listener's ability to identify the location or origin of a detected sound in direction and distance. It may also refer to the methods in acoustical engineering to simulate the placement of an auditory cue in a virtual 3D space.

The auditory system uses several cues for sound source localization, including time- and level-differences between both ears, spectral information, timing analysis, correlation analysis, and pattern matching. If the signals cannot be localized to the spatial region around the mouth, the system examines if the spatial characteristics of the signal is in line with a source located about the user's head 202. This can be accomplished using head-models which approximate the head-related transfer functions (HRTFs) from sources at different (angular) locations about the head. By computing a measure of fit of the data and the HRTFs, we can derive a confidence level that the signal frame either corresponds to a localized source about the head and that the ear-pieces are in binaural-compatible position or the location of the source is inconsistent with the head-model, implying that we are in a binaural-incompatible mode.

Spectral features such as coherence indicate whether the source is localized in space or not. Signals that are localized in space arrive coherently at the microphones embodied in the earpieces 204. The higher the coherence, the greater the probability that the source is localized in space. In one example, a threshold value is preset and if the coherence is found above the preset threshold, the system assumes that the source is localized. Once it is determined that the signal is a coherent signal, the spatial and spectral characteristics of the signals are analyzed to determine the position of the speech source. As mentioned previously, if the speech source is around the mouth region, the spectra at the two microphones must be similar, that is, the cross-correlation peak must have its maximum around the lag 0 (zero). In signal processing, cross-correlation is a measure of similarity of two waveforms as a function of a time-lag applied to one of them. If so, the signal processing mode is switched to the binaural processing mode.

In some embodiments, if the source is not localized around the mouth, it does not necessarily imply a binaural-incompatible scenario because it could simply be a localized noise source. To verify, the probability of localization is computed corresponding to a localization of a source about the head (by considering signal propagation around a head-model). If this probability is high (that is, above a preset threshold), it is concluded that the ear-pieces are in binaural-compatible mode, and there exists a localized, interfering sound source.

If the probability of the source being around the head is low (that is, below the preset threshold), the signal processing mode is switched to a fallback mechanism, which in one example can be monaural processing mode.

In other embodiments, a trained statistical model of the target speaker (the user of the device) may be used in the detection methodology described above. If the speech frame under analysis can be reliably identified to the target speaker but the localization of this source is not around the mouth, the scenario can be classified as being 'binaural-incompatible'.

In some embodiments, a module for detecting if a signal frame contains speech from the target speaker is provided. This module is an extension to improve the robustness of the detector. Alternatively, this module may be used to determine if the signal frame contains speech from the target-speaker or not. Such detection is based on a statistical model of the target speaker (the user of the device 100). The training of the speaker model may be done in a separate training session or online during the course of usage of the device 100. The features used for this statistical model may be extracted based on acoustic and/or prosodic information, e.g., the characteristics of the speaker's vocal tract, the instant pitch and its dynamics, the intensity and so on.

Figure 3:
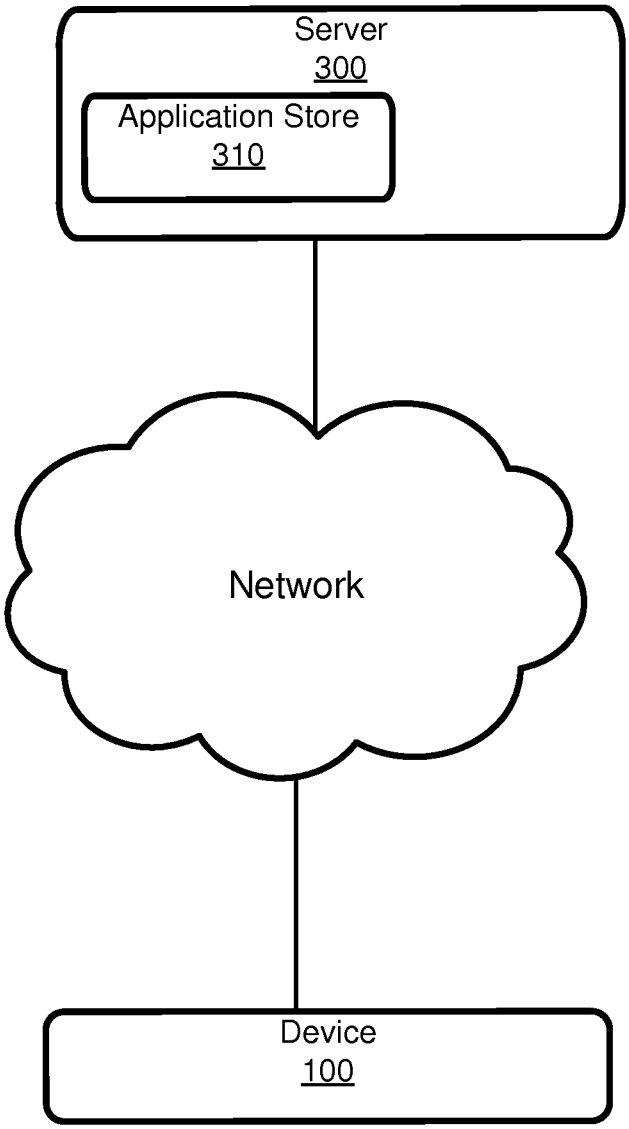
FIG. 3 is a schematic of a system for storing downloadable applications on a server that is connected to a network.

FIG. 3 illustrates a server 300 that includes a memory 310 for storing applications. The server 300 is coupled to a network. In one embodiment, the internal architecture of the server 300 may resemble the hardware device depicted in FIG. 1. The memory 310 includes an application that includes programming instructions which when downloaded to the device 100 and executed by a processor of the device 100, performs operations including switching between binaural processing mode and monaural processing mode. The programming instructions also cause the processor of the device 100 to perform speech processing and localization analysis as described above. After downloading the programming instructions from the server 300 via the network, the device 100 is configured to operations including switching between binaural processing mode and monaural processing mode.

Figure 4:
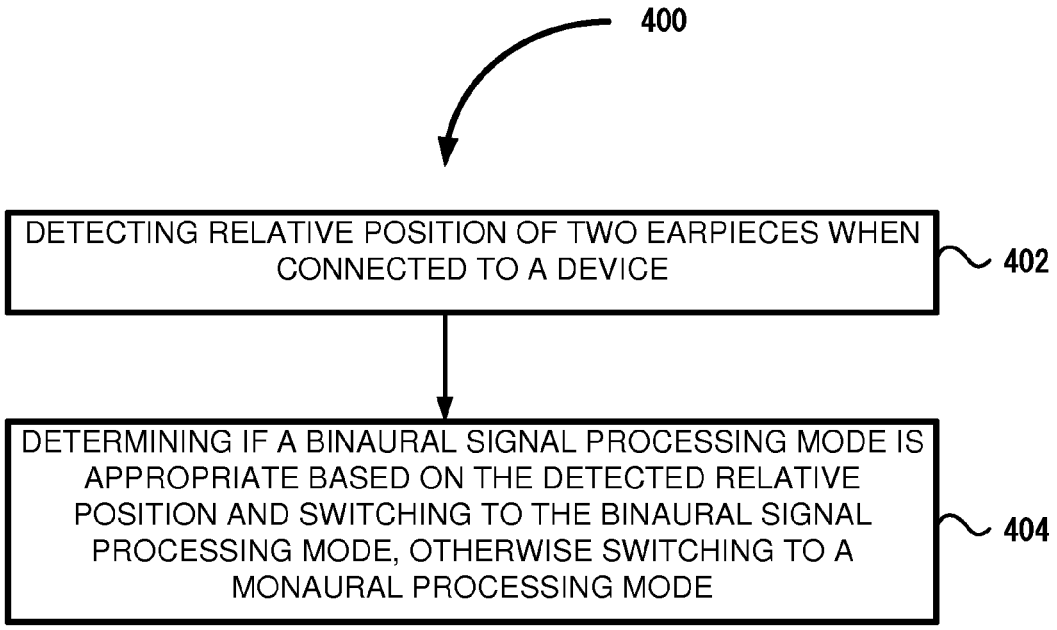
FIG. 4 is a method for switching between a binaural processing mode and a monaural processing mode in accordance with one or more embodiments of the present invention.

FIG. 4 illustrates a method 400 for switching between a binaural processing mode and a monaural processing mode. Accordingly, at step 402, the device 100 detects relative positions of the two earpieces that are connected to the device 100. At step 404, the signal processing mode is switched to a binaural processing mode if it is determined if the binaural processing mode is appropriate based on the determined relative position of the two earpieces. As explained in details above, among other things, the determination is also based on determining if the incoming signals contain speech and the source localization around the user's mouth.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. A device, comprising:

a processor; and a memory;

wherein the memory includes programming instructions which when executed by the processor cause the processer to perform an operation, the operation includes:

detecting a relative position of two earphones when connected to the device by applying head models that approximate head-related transfer functions from sources at different locations about a head;

determining that a binaural signal processing mode is appropriate based on the detected relative position, and in response, switching to the binaural signal processing mode for providing sound to the earphones; and determining that the binaural signal processing mode is not appropriate based upon the detected relative position, and in response, switching to a monaural processing mode.

2. The device of claim 1, wherein the programming instructions include a module for detecting speech activity in a signal frame.

3. The device of claim 1, wherein the programming instructions include a module for detecting if a signal frame is localized around a user's mouth using head-related transfer functions that correspond to a sound source at different angular locations about a head.

4. The device of claim 1, wherein the programming instructions include a module for detecting if a source of a signal frame is located about a user's head by:

detecting that coherence in arrival time of the signal frame at each earphone is below a threshold, and analyzing, in response to the detecting of the coherence, spatial and spectral properties of the signal frame to determine a position of the source.

5. The device of claim 1, wherein the programming instructions include a module for detecting if a signal frame contains speech from a target speaker based upon stored vocal statistics of the target speaker.

6. The device of claim 1, wherein the programming instructions include a module for switching between the binaural signal processing mode and the monaural processing mode.

7. The device of claim 1, wherein detecting relative position includes measuring similarity of two waveforms as a function of a time-lag applied to one of the two waveforms, wherein the two waveforms are captured by the two earphones.

8. The device of claim 7, wherein detecting relative position includes detecting if an input frame contains speech and a source of the speech is localized around a mouth of a user of the device.

9. A server connected to a network, the server comprising:

a processor;

a memory, wherein the memory includes programming instructions to configure a mobile phone, when the programming instructions are transferred, via the network, to the mobile phone and executed by a processor of the mobile phone, to:

detect relative position of two earphones connected to the mobile phone by approximate head-related transfer functions from sources at different locations about a head;

determine if a binaural signal processing mode is appropriate based on the detected relative position;

switch, in response to determining the binaural signal processing mode is appropriate, to the binaural signal processing mode; and switch, in response to determining that the binaural signal processing mode is not appropriate, to a monaural processing mode.

10. The server of claim 9, wherein the programming instructions include a module for detecting speech activity in a signal frame.

11. The server of claim 9, wherein the programming instructions include a module for detecting if a signal frame is localized around a user's mouth based upon speech spectrum correlation of high-frequency signals received at each of the earphones.

12. The server of claim 9, wherein the programming instructions include a module for detecting if a source of a signal frame is located about a user's head.

13. The server of claim 9, wherein the programming instructions include a module for detecting if a signal frame contains speech from a target speaker.

14. The server of claim 9, wherein the programming instructions include a module for switching between the binaural signal processing mode and the monaural processing mode.

15. The server of claim 9, wherein the detected relative position includes detecting if an input frame contains speech and a source of the speech is localized around a mouth of a user of the earphones.

16. A method performed in a device having two earphones for processing incoming speech signals, the method comprising:

detecting relative position of the two earphones when connected to the device by applying head models that approximate head-related transfer functions from sources at different locations about a head; and determining if a binaural signal processing mode is appropriate based on the detected relative position and switching to the binaural signal processing mode, wherein if it is determined that the binaural signal processing mode is not appropriate, switching to a monaural processing mode.

17. The method of claim 16, wherein the detecting of the relative position includes determining if an input frame contains speech and a source of the input frame is localized around a device user's mouth.

18. The method of claim 16, wherein the detecting of the relative position includes determining if a signal frame contains speech from a target speaker based upon stored vocal statistics of the target speaker.

19. The method of claim 16, wherein the detecting of the relative position includes measuring similarity of two waveforms as a function of a time-lag applied to one of the two waveforms, wherein the two waveforms are captured by the two earphones.

* * * * *